US005729091A

United States Patent [19]

Barthelmes et al.

[11] Patent Number: 5,729,091

[45] Date of Patent: Mar. 17, 1998

[54] METAL HALIDE DISCHARGE LAMP

[75] Inventors: Clemens Barthelmes; Andreas Hohlfeld; Jürgen Vom Scheidt, all of Berlin; Dietrich Fromm, Warngau, all of Germany

[73] Assignee: Patent-Treuhand-Gesellschaft F. Electrische Gluehlampen mbH, Munich, Germany

[21] Appl. No.: 619,536

[22] PCT Filed: Jun. 30, 1994

[86] PCT No.: PCT/DE94/00753

§ 371 Date: Jun. 20, 1996

§ 102(e) Date: Jun. 20, 1996

[87] PCT Pub. No.: WO95/10120

PCT Pub. Date: Apr. 13, 1995

[30] Foreign Application Priority Data

Oct. 6, 1993 [DE] Germany ..... 43 34 074.1

[51] Int. Cl.[6] ..... H01J 61/82

[52] U.S. Cl. ..... 313/638; 313/25; 313/626; 313/637

[58] Field of Search ..... 313/25, 626, 637, 313/638, 639, 640, 641

[56] References Cited

U.S. PATENT DOCUMENTS

| | | | |
|---|---|---|---|
| 3,484,637 | 12/1969 | van Boort et al. . | |
| 5,064,395 | 11/1991 | Kling et al. | 313/626 |
| 5,248,913 | 9/1993 | Heider . | |
| 5,352,952 | 10/1994 | Juengst . | |
| 5,432,300 | 7/1995 | Nagaswa et al. | 313/25 |

FOREIGN PATENT DOCUMENTS

| | | |
|---|---|---|
| 2062889 | 10/1992 | Canada . |
| 36 19 068 | 12/1987 | Germany . |
| 37 35 523 | 4/1988 | Germany . |

*Primary Examiner*—Nimeshkumar Patel

*Attorney, Agent, or Firm*—Frishauf, Holtz, Goodman, Langer & Chick, P.C.

[57] ABSTRACT

A metal halide discharge lamp with a coaxial discharge vessel (2) and outer bulb (9) contains a fill of metals with a tendency to diffusion. Their specific content is less than 6 μmols/cm$^3$. The current supply leads (4, 5) are surrounded, over a large portion of their length, by a sheath (14) that is UV-shielded.

10 Claims, 2 Drawing Sheets

METAL HALIDE DISCHARGE LAMP

FIELD OF THE INVENTION

Figure 1:
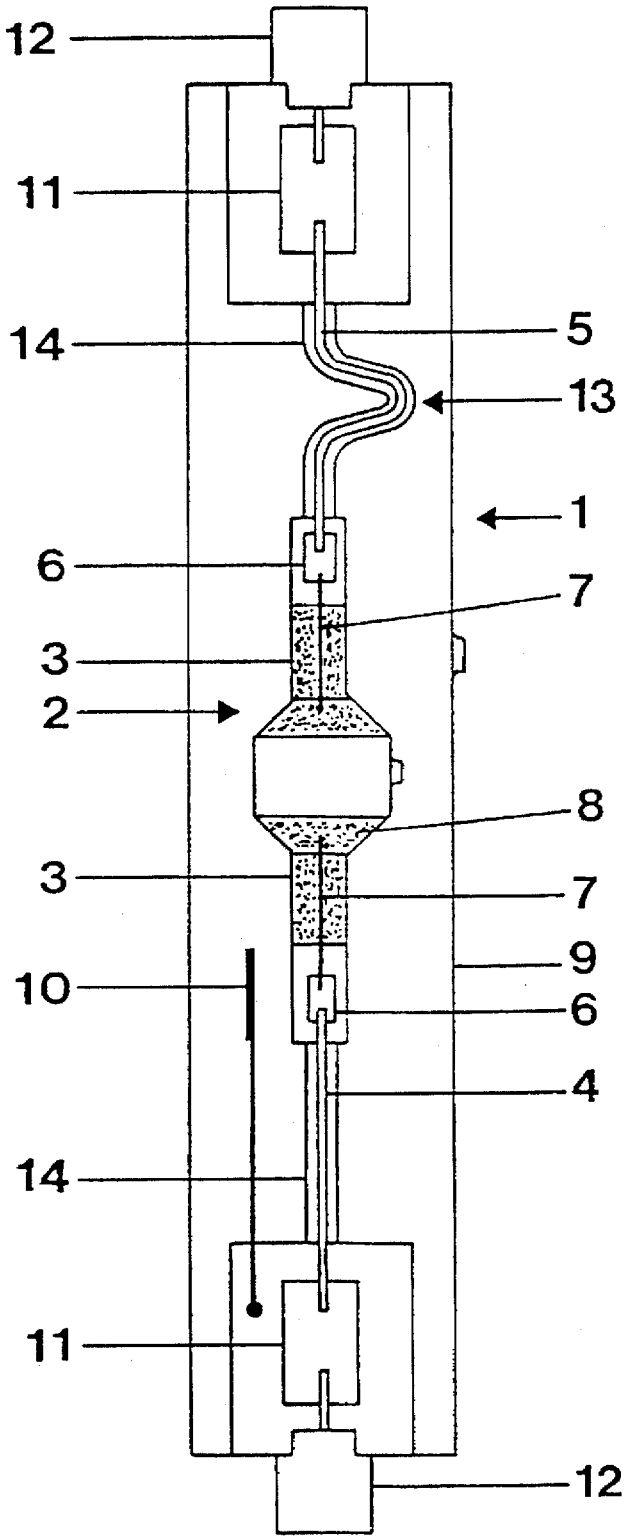

The invention relates to metal halide discharge lamps having a discharge vessel enclosed within an outer bulb, and especially to low power lamps with minimum halide fill.

BACKGROUND

Metal halide, or halogenide, discharge lamps, especially of low power, in particular about 50 to 250 W, are described, for example, in German Patent Disclosure Document DE-A 36 19 068. A discharge vessel pinched on both ends is located in a bulb pinched on both ends. To increase the safety of operation, especially toward the end of the service life, the current supply leads are surrounded by an electrically insulating jacket. Sheaths of ceramic, glass or quartz glass are especially suitable for this. At the same time, it is noted that the development of photoelectrons (see German Utility Model DE-U 900 29 59, for instance) can be precluded by disposing the discharge vessel and outer bulb in such a way that frame parts extending parallel to the discharge vessel are not needed.

In metal halide lamps with a fill containing alkali metal and in which a conductor is extended along the discharge vessel, as is the case for a discharge vessel pinched on both ends in an outer bulb pinched on one end, it is known for the portion of the current supply lead extending along the discharge vessel to be provided with an electrically insulated, UV-impermeable shield, and especially a small tube of glass, ceramic or quartz glass (German Patent Disclosure DE-A 16 39 084).

THE INVENTION

It is the object of the invention to improve the operating performance of metal halogenide discharge lamps.

Briefly, an ultraviolet (UV) shielding jacket surrounds the leads from the discharge vessel which extend within the outer bulb, and the content of metals subject o diffusion in the discharge vessel is less than 6 μmols/cm$^3$ of the discharge volume.

Surprisingly, it has been found that the targeted use of a jacket that is impermeable to UV radiation, for current supply leads located in the outer bulb, also has advantages under certain circumstances in metal halogenide discharge lamps that have a discharge vessel pinched on both ends in an outer bulb pinched on both ends. In the previously prevailing opinion, such lamps were thought not to have any problems of photoionization. This means metal halogenide discharge lamps primarily of low power (typically 50 to 250 W) with a fill containing sodium. It has been found that here the use of a UV-shielding jacket that covers the current supply leads in the outer bulb as completely as possible makes it possible to keep the fill quantities of metal halides, and especially the sodium-containing component (such as NaI), quite low yet nevertheless very long service lives can be attained (about 6000 hours of operation). As a rough guideline it can be said that the total fill quantity (in mg) of metal halides can be limited to a maximum of three times the volume of the discharge vessel (in cm$^3$ ).

It is advantageous to consider the lower limit to be a total fill quantity (in mg) of metal halides that is 1 (one) times the discharge volume (in cm$^3$). The reason is that—especially in fill systems of sodium and rare earth—the residual oxygen is reliably absorbed in this way, because of the gettering effect of the fill components.

Previous experiments with lamps with this kind of small dose have demonstrated comparatively poor maintenance, because of a failure to recognize that even with this type of lamp, a slight but certainly notable photoionization occurs over the service life, which leads to depletion of fill components and especially of the sodium in the discharge vessel. The consequence was a drop in the partial pressure of this fill component, especially of the sodium, and an increase in the operating voltage along with an undesired drift toward higher color temperatures. Lamps according to the invention, however, exhibit very good maintenance of their light flux over the service life. The performance is similar for the color temperature as well.

The actual cause of poor maintenance is the diffusion of sodium ions, or other metal ions with a short ion radius (such as lithium) through the discharge vessel (generally made of quartz glass; under some circumstances a ceramic discharge vessel may also be used, as described for instance in European Patent Disclosure EP-A 536 609). The condition for the fill quantity can be specified such that the pure proportion of metals with a short ion radius (above all, sodium)—which therefore have a tendency to diffusion and will hereinafter be called diffusion-metals—expressed in micromols (μmol) in the filling is less than six times the discharge volume, expressed in cubic centimeters (cm$^3$). This can be expressed in formula form as follows: specific diffusion metal content $\leqq 6$ μmol/cm$^3$.

A value of one times the discharge volume (in cm$^3$) can be considered as a lower limit for the diffusion-metal content; that is, a specific diffusion-metal content $\leqq 1$ μm/cm$^3$. Preferred values of the diffusion metal content are in the range of four times the discharge volume.

The term "short ion radius" is understood to mean values of a maximum of approximately 0.1 nm, of the kind that $Na^+$ or $Li^+$, for instance, have.

The invention is especially suitable for fill systems of sodium and rare earth. Similarly good results are obtained in NaSc fills.

The primary field of application is lamps with color temperatures on the order of magnitude of 4000K (neutral white light color), in which the sodium content can be chosen to be less than in warm white light colors (color temperature of approximately 3000K).

It should also be noted that the increase in operating reliability mentioned at the outset plays a role only in those lamps that have an evacuated outer bulb, and in which the electrode (of tungsten) and current supply lead (of molybdenum) are of different materials. Only here does the use of corrosion-promoting fills (which means primarily sodium-tin fills) lead to electrode corrosion and hence to leakage of the discharge vessel and finally to lethal DC operation. By contrast, the lamps according to the invention may have either an evacuated outer bulb or an outer bulb filled with inert gas such as nitrogen). Moreover, the question of the material of the electrode and current supply lead plays no role.

Figure 2:
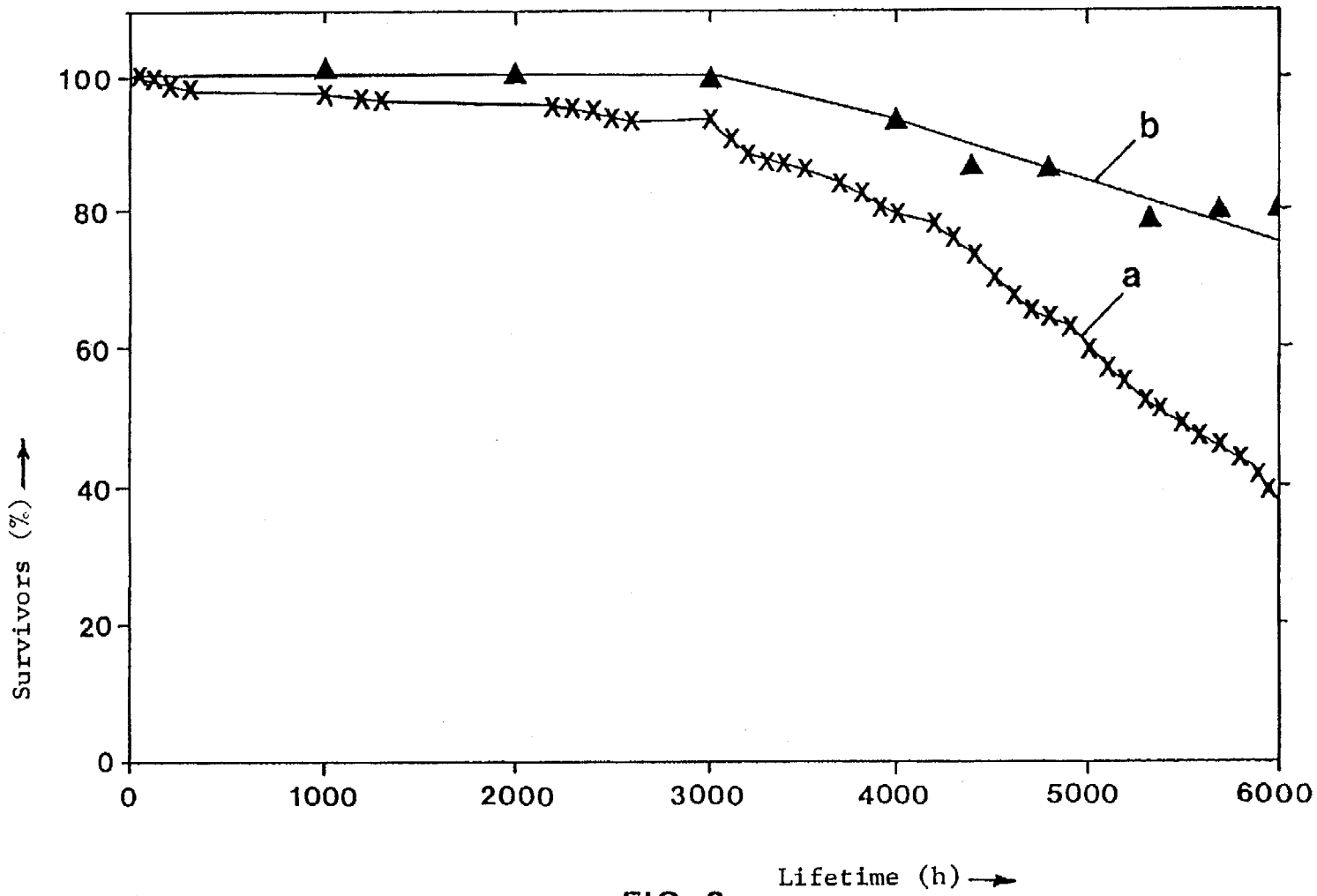

The invention will be described below in detail in terms of an exemplary embodiment. Shown are:

FIG. 1, a lamp according to the invention;

FIG. 2, the mortality curve of a group of lamps according to the invention and of a comparison group.

The high-pressure discharge lamp 1 schematically shown in FIG. 1, with a power consumption of 70 W, comprises a substantially cylindrical quartz glass discharge vessel 2, which bulges out in the middle. It is closed on each of both ends with a pinch 3, through which the two current supply leads 4, 5 are introduced in vacuum-tight fashion by means of foils 6, thereby making an electrical connection with the electrodes 7 (of thoriated tungsten) mounted in the discharge vessel. The ends of the discharge vessel are provided with a heat-reflecting coating 8. The fill with the neutral white light color comprises the metals Hg and Na, with additives of further metals of the rare earth series and of the halogens Br and/or I. A preferred metal halide fill is 0.45 mg of NaI, 0.27 mg each of the rare earth metal halides $DyI_3$, $HoI_3$ and $TmI_3$, and 0.13 mg of TlI. The discharge volume is 0.7 $cm^3$.

The discharge vessel 2 is located in a coaxially arranged cylindrical quartz glass outer bulb 9, with the minimum wall spacing being only about 2 to 3 mm. A getter 10, which extends parallel to one of the current supply leads 4, is located potential-free in this outer bulb in a known manner. The outer bulb 9 is also closed on both ends each with a pinch, and the electrical connection of the axially located current supply leads 4, 5 to the outside is effected in each case via a vacuum-tight foil pinch seal 11 and ceramic base parts 12 (with small-plate contacts). The current supply leads 4, 5 retain the discharge vessel 2 in the outer bulb 9, and one of the current supply leads 5 is provided with an expansion loop 13 to compensate for length tolerances. The necessity for an expansion loop 13 depends on the dimensions of the lamp.

In accordance with the invention, the operating performance over the life of a double-ended double-pinch-sealed lamp with an outer bulb 9 is improved by preventing photoionization, which leads to depletion of fill metals due to diffusion through the discharge vessel 2. Accordingly, the two current supply leads 4, 5 are surrounded over their entire length, extending within the outer bulb 9, by a stocking-like sheath 14 of quartz silk. This material is temperature-resistant to 1200° C. One example is the silicate hose type S-R 05 made by Lippmann (Schwerte, Germany). This sheath has a wall thickness of 0.3 mm and an inside diameter of 0.4 mm. It is over 95% $SiO_2$ by composition.

This material is so flexible that it easily conforms to the flexing of the expansion loop. A ceramic fiber hose or quartz fiber hose is also suitable for the purpose.

In the case of straight current supply leads, a less-flexible material, such as a small hard glass or quartz glass tube or a rigid ceramic sheath, can also be used. The essential properties are high temperature resistance and adequate UV absorption.

FIG. 2 shows a comparison between the service life of the lamps described in conjunction with FIG. 1, without sheathing of the current supply leads (measurement points marked X) and with such sheathing (measurement points shown as triangles). The dose of the fill was the same for both measurement groups. Because of the low dose in the fill, the number of surviving lamps that lack sheathing (curve a) drops after 6000 hours in operation to 39%, while for the group with sheathing according to the invention (curve b) the number is still about twice as high (approximately 75%). At 3000 hours in operation, no failure whatever can be found in this group; not until after 7500 hours is a 50% failure rate attained.

The invention is applicable to all discharge vessels closed on both ends that are mounted approximately axially in outer bulbs closed on both ends. The discharge vessel can in particular be a quartz glass burner pinched on both ends or a ceramic tube sealed on both ends. The outer bulb is in particular a hard glass or quartz glass bulb pinched on both ends.

As the sheathing, a ceramic suspension applied directly as a coating to the current supply lead, such as $ZrO_2$, is especially suitable. This technique also has manufacturing advantages over separate sheaths and is also suitable for flexible current supply leads. The layer thickness is about 0.15 mm. To improve adhesion, up to 15% and in particular 10 weight % of boron oxide is added.

We claim:

1. A long-life, metal halogenide discharge lamp having a discharge vessel (2) closed on both ends, which contains two electrodes and defines a discharge volume therein;

a fill in said discharge volume of metals with a tendency to diffusion, which diffusion-metals, in operation of the lamp, have a tendency to form ions with a short ion radius, wherein the ion radius is in the order of magnitude of $Na^+$ ion; and a cylindrical outer bulb (9) surrounding the discharge vessel (2), which defines an axis and is closed on both ends;

wherein the discharge vessel (2) is located approximately axially in the outer bulb (9) and is retained therein by two current supply leads (4, 5) located in the outer bulb (9), characterized by the combination of:

the specific diffusion metal content in the discharge volume being less than 6 μmols/$cm^3$; and a photoionization, and hence diffusion-metal diffusion-inhibiting arrangement, which arrangement comprises a UV-shielding jacket or sheath (14) surrounding the current supply leads (4, 5) located in the outer bulb (9) over a great portion of their length.

2. The metal halogenide discharge lamp of claim 1, characterized in that the diffusion-metal is sodium.

3. The metal halogenide discharge lamp of claim 1, characterized in that the specific diffusion-metal content is at least 1 μmols/$cm^3$ of the volume of the discharge vessel (2).

4. The metal halogenide discharge lamp of claim 1, characterized in that the shielding jacket or sheath (14) is manufactured from one of the materials of the group consisting of at least one of ceramic, hard glass, quartz glass.

5. The metal halogenide discharge lamp of claim 4, characterized in that the jacket or sheath (14) is flexible.

6. The metal halogenide discharge lamp of claim 1, characterized in that the total fill quantity of metal halides (in mg) is equivalent to a maximum of three times the volume (in $cm^3$) of the discharge vessel.

7. The metal halogenide discharge lamp of claim 1, characterized in that the lamp power is a maximum of 250 W.

8. The metal halogenide discharge lamp of claim 1, characterized in that the jacket or sheath (14) is a coating of a ceramic suspension, in particular $ZrO_2$, which contains up to 15 weight % of boron oxide.

9. The metal halogenide discharge lamp of claim 1, characterized in that the specific diffusion-metal content is in the range of 4 μmols/$cm^3$ of the volume of the discharge vessel (2).

10. An arrangement to avoid photoionization when slight quantities of diffusion-metal fills, optionally sodium, are enclosed in a lamp discharge vessel (2) of a $metal_{13}$ halide discharge lamp, comprising a sheath or jacket (14) of quartz glass material, hard glass material or ceramic material, for current supply leads (4, 5) extending from the discharge vessel (2) into a cylindrical outer bulb (9) of the metal halide discharge lamp, in which the discharge vessel (2) is pinched on both ends and is located approximately axially in the outer bulb (9), which defines an axis and is closed on both ends, wherein the diffusion-metal quantity is less than 6 μmols/$cm^3$, with reference to the volume of the discharge vessel (2).

* * * * *